US010271385B2

(12) United States Patent
Unalan et al.

(10) Patent No.: US 10,271,385 B2
(45) Date of Patent: Apr. 23, 2019

(54) METAL NANOWIRE DECORATED HEATABLE FABRICS

(71) Applicants: Husnu Emrah Unalan, Ankara (TR); Doga Doganay, Ankara (TR); Sahin Coskun, Ankara (TR)

(72) Inventors: Husnu Emrah Unalan, Ankara (TR); Doga Doganay, Ankara (TR); Sahin Coskun, Ankara (TR)

( * ) Notice: Subject to any disclaimer, the term of this patent is extended or adjusted under 35 U.S.C. 154(b) by 0 days.

(21) Appl. No.: 15/576,288

(22) PCT Filed: Aug. 23, 2016

(86) PCT No.: PCT/TR2016/050302

§ 371 (c)(1),
(2) Date: Nov. 22, 2017

(87) PCT Pub. No.: WO2017/034497

PCT Pub. Date: Mar. 2, 2017

(65) Prior Publication Data

US 2018/0132310 A1 May 10, 2018

(30) Foreign Application Priority Data

Aug. 26, 2015 (TR) ..... a 2015 10587

(51) Int. Cl.
*H05B 1/02* (2006.01)
*H05B 3/34* (2006.01)

(52) U.S. Cl.
CPC ..... *H05B 3/342* (2013.01); *H05B 2203/029* (2013.01); *H05B 2203/036* (2013.01); *H05B 2214/04* (2013.01)

(58) Field of Classification Search
CPC .. H05B 3/342; H05B 3/345; H05B 2203/029; H05B 2203/036; H05B 2214/04; H05B 1/0272; H05B 3/023; H05B 3/12
See application file for complete search history.

(56) References Cited

U.S. PATENT DOCUMENTS 7,442,575 B2 * 10/2008 Coffer ..... B82Y 10/00 257/14
8,424,119 B2 4/2013 Blackford
(Continued)

FOREIGN PATENT DOCUMENTS

EP 2525625 A 11/2012
EP 2687364 A1 1/2014
(Continued)

OTHER PUBLICATIONS

Caroline Celle et al: "Highly flexible transparent film heaters based on random networks of silver nanowires", Nano Research, vol. 5, No. 6, May 18, 2012 (May 18, 2012), pp. 427-433, XP055201042, ISSN: 1998-0124, DOI: 10. 1007/s 12274-012-0225-2 the whole document.

(Continued)

*Primary Examiner* — Mark Paschall
(74) *Attorney, Agent, or Firm* — Gokalp Bayramoglu

(57) ABSTRACT

The invention of the application relates to obtaining a three dimensional coating on fabrics with dip coating method of silver nanowires, which allow fabric to breathe, do not limit the flexibility or restrict the use of the fabric, and heating these coatings with an applied voltage. Moreover, this coating also enables fabrics to be antibacterial and flame retardant.

10 Claims, 4 Drawing Sheets

(56) References Cited

U.S. PATENT DOCUMENTS

| | | | | |
|---|---|---|---|---|
| 8,937,268 | B2 * | 1/2015 | Kuriki | H05B 3/84 219/528 |
| 9,890,894 | B2 * | 2/2018 | Withers | F16L 55/1686 |
| 2009/0096348 | A1 * | 4/2009 | Liu | H01J 29/20 313/498 |
| 2009/0252861 | A1 | 10/2009 | Tessier et al. | |
| 2010/0118868 | A1 | 5/2010 | Dabagh et al. | |
| 2011/0285019 | A1 | 11/2011 | Alden et al. | |

FOREIGN PATENT DOCUMENTS

| | | | |
|---|---|---|---|
| EP | 2801658 | A1 | 11/2014 |
| WO | 2005027580 | A1 | 3/2005 |
| WO | 2011116469 | A1 | 9/2011 |

OTHER PUBLICATIONS

Duckjong Kim et al: "Transparent flexible heater based on hybrid of carbon nanotubes and silver nanowires", Carbon, vol. 63, Nov. 1, 2013 (Nov. 1, 2013), pp. 530-536, XP055201046, ISSN: 0008-6223, DOI: 10. 1016/j.carbon. 2013. 07. 030 the whole document.
Po-Chun Hsu et al. "Personal Thermal Management by Metallic Nanowire-Coated Textile", Nano Letters (DOI: 10.1021/nl5036572).

* cited by examiner

| | S.aureus Starting Concentration: 1.5x108 cfu/mL | E.coli Starting concentration: 1.5x108 cfu/mL | B. cereus Starting concentration: 1.5x108 cfu/mL | C.albicans Starting concentration: 1.5x108 cfu/mL |
|---|---|---|---|---|
| Cotton fabric | 1.75x106 | 1.82x106 | 1.2x102 | 74 |
| Fabric coated with silver nanowires | 0 | 0 | 0 | 0 |

FIG. 4

METAL NANOWIRE DECORATED HEATABLE FABRICS

CROSS-REFERENCE TO RELATED APPLICATIONS

This application is the national phase entry of International Application No. PCT/TR2016/050302, filed on Aug. 23, 2016, which is based upon and claims priority to Turkish Patent Application No. 2015/10587, filed on Aug. 25, 2015, the entire contents of which are incorporated herein by reference.

TECHNICAL FIELD

The invention herein relates to decoration of silver nanowires as a three dimensional coating on textiles with dip coating method, where the coating is breathable, do not limit the flexibility or restrict the use of the fabric, heatable with an applied voltage, flame retardant and antibacterial.

BACKGROUND

Attempts have been made to develop fabrics with heaters by implementing several different approaches in the previous studies. Among them, systems that employ resistor type heaters are very well-known and commercially available. Electrical blankets may be given as an example to this group. However, resistor type heaters result in very high power consumption due to their high resistance. These heaters are very heavy for small and portable applications. Since they run on electricity grid, they threaten the users with the risk of electric shock.

Another type of heated fabric is semi-conductor thin film based fabric heaters. In such heaters, the fabric is entirely coated with a thin film material, which limits breathability of the fabric. Besides, the thin film structure restricts the flexibility of the textile; therefore, its adaptation in wearable technologies is limited.

Finally, carbon nanotube coated fabric heaters were developed. Heating performances of the heatable fabrics developed with carbon nanotubes are very low. Increasing their thermal performances may only be achieved with the use of large amounts of nanotubes. However, in that case both the cost increases and the breathability of the fabric gets negatively affected.

Regarding the known status of the technique, there are similar publications and patent documents to the mentioned invention.

The patent no. US 2011/0285019 A1 is related to the production of transparent and conducting materials by means of metal nanowires. The patent in question identifies that metal nanowires are deposited onto substrates with different methods and the obtained network structure enabled these coatings to be transparent under visible light and electrically conducting. The most common use of silver nanowires is the fabrication of transparent and conducting electrodes. The obtained transparent and conducting thin films are developed as an alternative to the indium tin oxide (ITO) material, which is commonly used in this field. The use of silver nanowire transparent and conducting thin films have been demonstrated in many prototype electronic devices such as organic solar cells, organic light emitting diodes and photodetectors in laboratory.

The publication by Po-Chun Hsu et al. "Personal Thermal Management By Metallic Nanowire-Coated Textile", Nano Letters (DOI:10.1021/n15036572) is basically related with the back reflection of the infrared beams emitted by the human body through precise control of the silver nanowire density and the fiber spacing of the used fabrics. At the end of the study, it is demonstrated that silver nanowire and carbon nanotube coated fabrics could be heated up under applied voltages. However, the highest temperature obtained is around 50° C. This temperature will be insufficient while in service considering the necessary insulation materials used in the fabrication of the final product.

In the same publication, Po-Chun Hsu et al. also investigated the antibacterial properties of silver nanowire decorated textile against *Escherichia coli* bacteria. Although the examination of a single type of bacteria is a preferred method in antibacterial tests, it is not sufficient alone in the identification of antibacterial efficacy of the textiles to be used.

U.S. Pat. No. 8,424,119 B2 demonstrates the reflection of infrared light emitted by the human body by means of small circular metallic thin films enabling the conservation of temperature. However, since there is no connection between these thin films, they may not be heated by means of a voltage.

Patent no. WO2011116469 A1 intends to deposit carbon nanotubes onto textile surfaces and thus reflect back the infrared light emitted by the human body. However, the major disadvantage of such studies is the temperature gain, which will be only a few degrees in the case of back reflection.

In patent no. US2010/0118868 A1, carbon nanotube/metal particle mixture is used to heat a vehicle steering wheel by means of "Joule Heating" mechanism. This material showed slow response and low heating performance.

In patent no. WO2005027580 A1, conductive steel fibers were knitted in conjunction with the textile fibers during weaving of the textile. The heater fabricated therein operated with alternating current from the electricity grid. This both restricts the mobile applications and threatens the health of the user.

In Patent no. EP2801655 A1, motives were created on the fabric surfaces by means of carbon nanotubes and carbides of transition metals. Heat generated from the sunlight is transferred to the entire fabric by means of carbon nanotubes. In this method, under sunlight, a temperature increase of only 10° C. can be obtained in twenty minutes.

In patent no. EP2525625 A, heatable textiles were fabricated through the deposition of semiconductor resins onto the textiles. However, the resins entirely covered the textile surface and restricted the breathability of the textile. It also restricted the flexibility of the textile.

SUMMARY OF THE INVENTION

The objective of the invented metal nanowire decorated heatable fabric is to obtain a heatable fabric through the use of metal nanowire heating materials as a coating, which does not limit the breathability, flexibility and restrict the use of the textile, reach the desired variable temperatures depending on the field of application under low applied voltages (max. 60° C. for wearable products) within a few minutes, can be kept at that constant temperature for the desired amount of time; cool back to the room temperature once the applied voltage is cut, and reversibly heat up to the same temperature again upon the reapplication of voltage; and is also antibacterial and flame retardant.

BRIEF DESCRIPTION OF THE DRAWINGS

The figures that show the results of experiments related with metal nanowire decorated heatable fabric developed with this invention are defined as follows:

FIG. 4—*Escherichia coli* (*E. coli*), *Staphylococcus aureus* (*S. aureus*), *Bacillus cereus* (*B. cereus*), *Candida albicans* (*C. albicans*) microorganisms' adhesion capacity results on bare cotton and silver nanowire decorated cotton fabrics.

DETAILED DESCRIPTION OF THE INVENTION

Figure 1A:
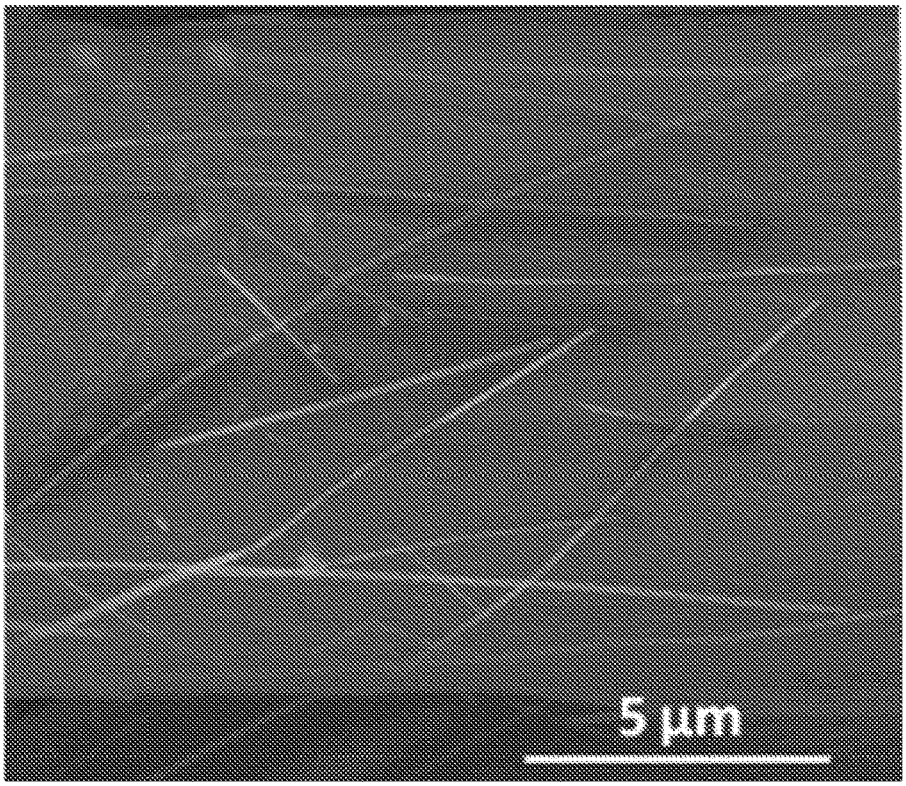
FIG. 1A—Scanning electron microscope (SEM) image at magnification of 5 μm fabric fibers covered with silver nanowires.
Figure 1B:
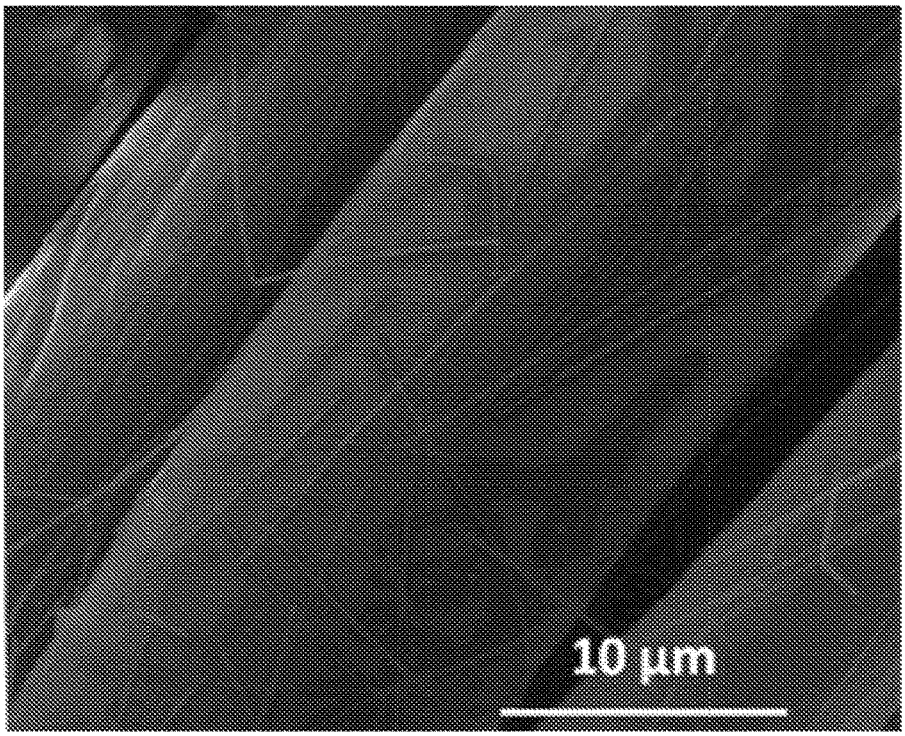
FIG. 1B—Scanning electron microscope (SEM) image at magnification 10 μm of fabric fibers covered with silver nanowires.
Figure 1C:
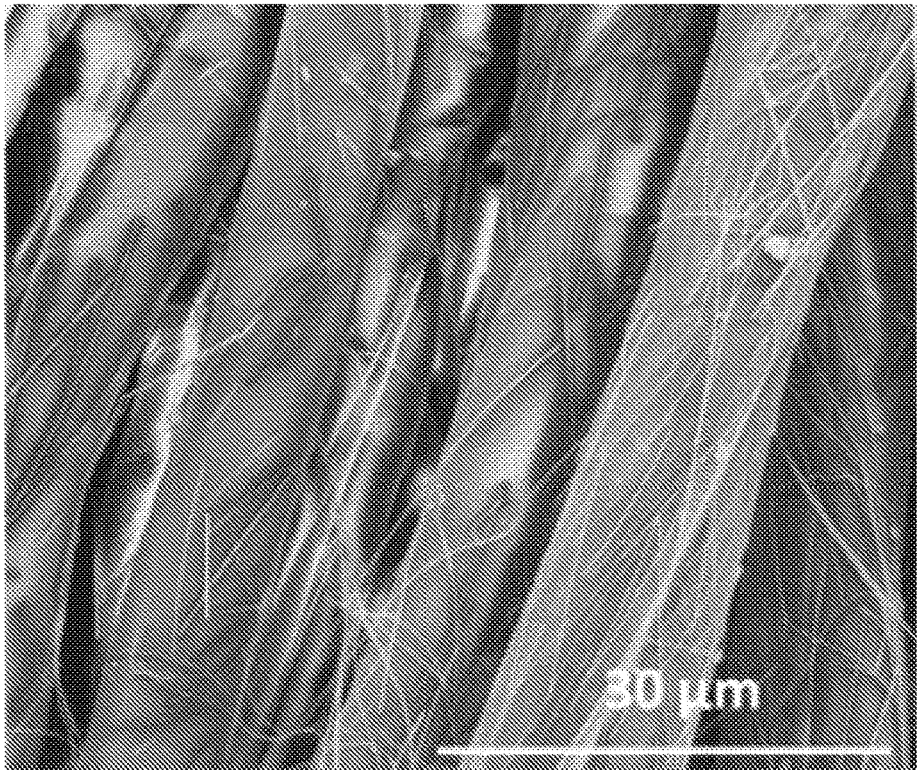
FIG. 1C—Scanning electron microscope (SEM) image at magnification 30 μm of fabric fibers covered with silver nanowires.
Figure 1D:
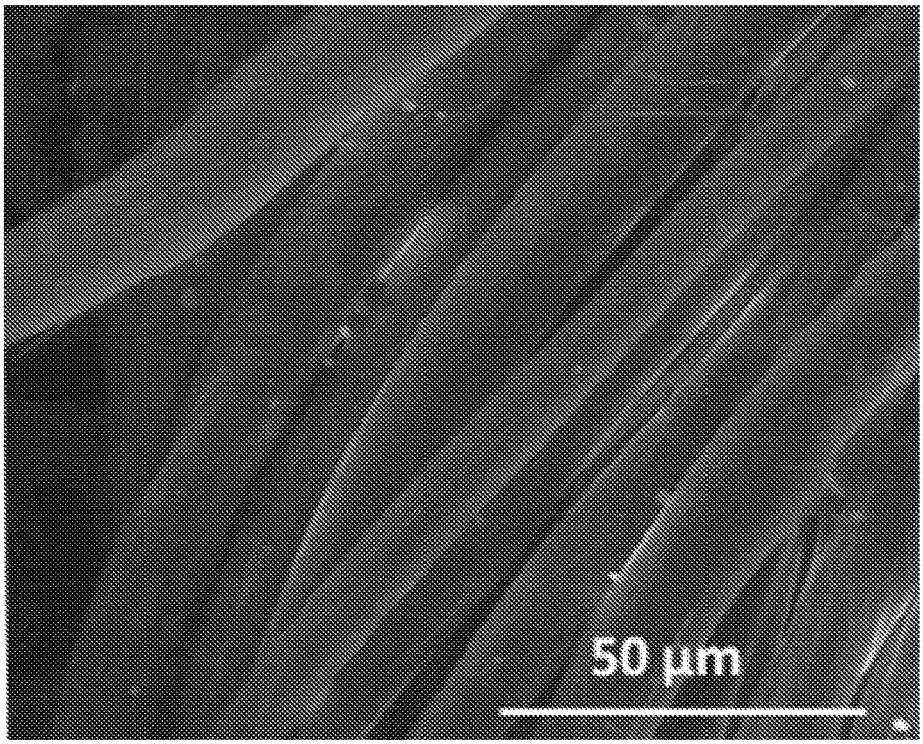
FIG. 1D—Scanning electron microscope (SEM) image at magnification 50 μm of fabric fibers covered with silver nanowires.

The invention herein relates to obtaining a three dimensional coating on fabrics via dip coating method of silver nanowires, which allows fabric to breathe, do not limit the flexibility or restrict the use of the fabric, and allows heating of these coatings with an applied voltage. Three dimensional conductivity is obtained through the decoration of silver nanowires thanks to the knitted structure of the fabric material.

In addition to the silver nanowires for the fabrication of heatable fabrics; other metal nanowires such as gold, copper, platinum, nickel, copper-nickel mixture may also be used. Furthermore, metal nanowire decorated heatable fabrics may also be fabricated with spray coating, drop casting and spin coating in addition to dip coating investigated here.

This study makes use of the high inherent electrical and thermal conductivity of the metallic materials. Besides, when these materials are produced in nanowire form and decorated onto fabrics a nanowire density in the range of 0.05 mg/cm$^2$-50 mg/cm$^2$ is used, while maintaining the flexibility of the fabrics. Low power consumption is one of the most important advantage of the metal nanowire decorated heatable fabrics both in terms of their cost of usage and health concerns. Besides, operation of these devices with portable batteries allows for their convenient use in mobile applications.

Metal nanowire decorated heatable fabrics refer to a very wide area of use. Some of them can be listed as heated pillows, seat, cushion, carpet, curtain, bedsheets, sweater, rug, anorak, shirt, trousers, shoes, boots, jacket, gloves, T-shirt, weal, scarf, steering wheel, blanket, portable heater, quilt, mattress, undergarment, socks and corset. Different temperatures are required for different applications.

Decorating silver nanowires onto fabric surfaces is carried out with dipping and drying method. Bare fabric (any kind of knitted or not knitted, cotton, silk, woolen or synthetic or their blends) is dipped in silver nanowire containing ethanol solution and rested for approximately 10 seconds, then the fabric is removed and dried at a temperature around 60° C. for quick evaporation of ethanol. The density of nanowire on the fabric is increased by repeating this dipping, resting and drying process. At the end of dipping, resting and drying process, the fabric decorated with silver nanowires is obtained. Instead of the solution in which bare fabric is dipped, a solution prepared with metal nanowires such as gold, copper, platinum, nickel and copper-nickel, and alcohol, acetone or organic solvents can also be used.

The decoration of silver nanowires on fabric surfaces with dip coating method is monitored by means of scanning electron microscopy (SEM). An SEM image showing silver nanowire decorated fabric fibers is provided in FIG. 1. As will be understood from the microscope image, silver nanowires are decorated onto the fabric fibers in a very homogeneous form, and provide a three-dimensional conductivity with their contacts to each other. Coatings with low resistance can be obtained thanks to high conductivity of silver nanowires. These coatings obtained may be heated under low applied voltages (direct current).

It is foreseen that different temperature requirements may arise under different environmental conditions. The temperature required for the applications in direct contact with the skin such as socks and undergarment is foreseen as 30-35° C. However, if they are used as the inner lining of the marketed gloves, shoes and coats, then higher temperatures will be needed. In that case, a temperature of 40-50° C. will be sufficient. Even higher temperatures are foreseen for the heaters used in car seats. The reason is that the fabric is not in direct contact with the skin due to the other items that compose the seat and the clothes on the driver's body.

Figure 2:
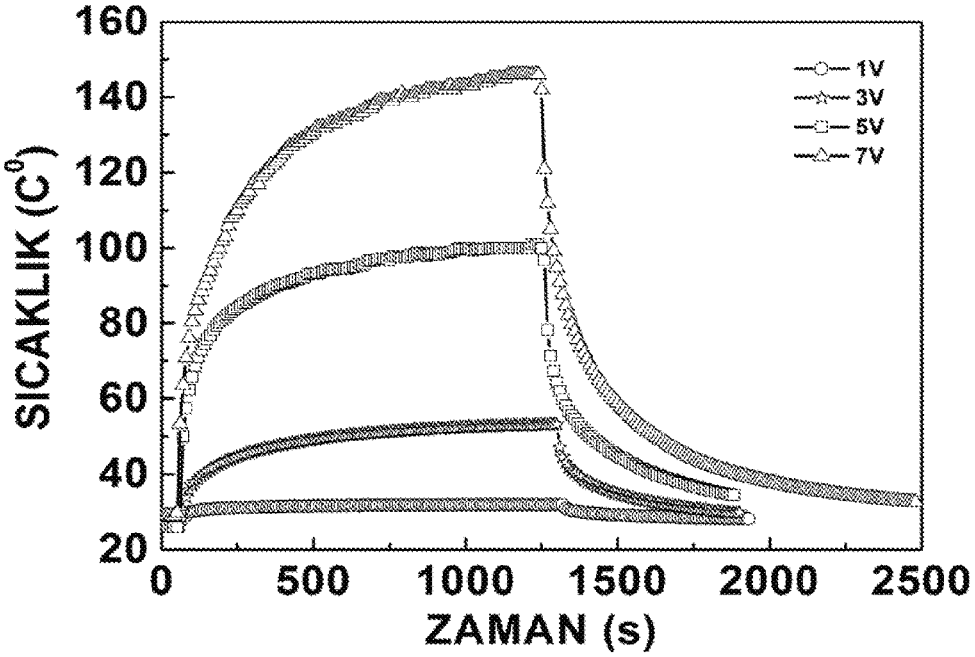
FIG. 2—Heating profile of silver nanowire decorated cotton fabric under different voltages.

Cotton fabrics were decorated with silver nanowires by means of dip coating, electric contacts are printed by silver paste at the both ends of the fabric, and then the heating behavior under different voltages are examined. Temperature changes are observed under an applied voltage range of 0.5 V-15 V. As clearly noted in FIG. 2, the temperature was observed to increase to 30° C. under 1V, to 50° C. under 3V, to 100° C. under 5V, and 150° C. under 7V. The temperature-voltage relation here depends on the nanowire density in unit area. These temperatures can be kept constant provided that the voltage is applied. A temperature between 30-150° C. is obtained under applied biases between 1-7 V. These results indicate that the beatable fabrics can be used in various applications.

In order to be suitable for casual and mobile use, heaters must have high performance and should consume low power. The power consumed by the fabricated fabrics under applied biases of 1, 3, 5 and 7 V were measured as 0.15, 0.77, 2.1 and 3.92 Watts, respectively. Power consumption under a voltage range of 1-7 V is in a range of 0.1-10 Watt, particularly in 0.15-3.92 Watt range. These values are quite lower than those values reported for the products in the market.

Figure 3:
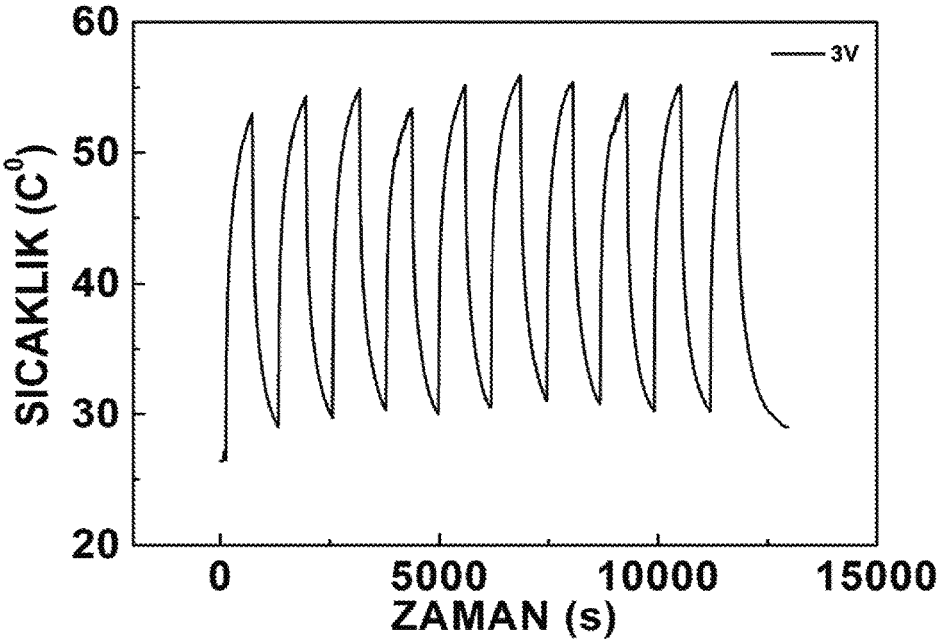
FIG. 3—Heating profile of silver nanowire decorated cotton fabric subjected to 10 repetitive heating/cooling cycles at an applied bias of 3V.

Reusability of the heatable fabrics is an important feature. The graph in FIG. 3 shows that the heating performance of silver nanowire decorated fabric do not change after 10 uses. As seen in FIG. 3, a 3V bias is applied to the silver nanowire decorated fabrics for 10 minutes, then the fabric easily returns back to room temperature when the bias is cut, and it rises back to the same temperature upon reapplication of the same bias. This operation is repeated successively for 10 times. Both the attained temperature and the response/recovery times remain constant. The heating and cooling here can be repeated for several times.

Antimicrobial inhibition effects and the effectiveness of 1×1 cm$^2$ sized bare and silver nanowire decorated fabrics with a nanowire loading in the range of 0.05 mg/cm$^2$-50 mg/cm$^2$ are tested against bacteria with different cell wall structures and a unique fungus type *Candida albicans* (*C. albicans*) were investigated by agar diffusion test. For this purpose, *Staphylococcus aureus* (*S. aureus*) with Gram positive cell wall, *Escherichia coli* (*E. coli*) with Gram negative cell wall, *Bacillus cereus* (*B. cereus*) a gram positive bacteria with spores, and *C. albicans* species as an opportunistic pathogen fungus found in the bodies natural flora are tested for their antimicrobial efficacies with the conventional microbiological techniques. Furthermore, in order to examine the adhesion capacities of the microorganisms on the fabricated materials, the bacteria and fungus suspensions prepared at a concentration of $1.5\times10^8$ cfu/mL and spectrophotometrically determined optical density set at OD: 0.600450 nm, are placed on the fabrics in equal amounts (100-500 μl) and rested in the incubator for 4 hours at 37° C. Then they are washed twice with phosphate buffered water, and they are diluted with deionized sterile water at certain dilution rates ($10^{-1}$, $10^{-2}$, $10^{-3}$), and for each microorganism, they are seeded on each bacterial lawn in equal amounts (100 μl), and are incubated at 37° C. under aerobic conditions for one night. At the end of the incubation period, the colonies of the microorganisms produced on the bacterial lawns are counted and calculated in colony forming units (CFU)/mL taking into account their dilution rates.

Metal nanowire decorated antibacterial fabrics refer to a very wide area of use. Some of them are pillow, seat, cushion, carpet, curtain, bedsheets, sweater, rug, anorak, shirt, trousers, shoes, boots, jacket, gloves, T-shirt, weal, scarf blanket, portable heater, quilt, mattress, various undergarments, socks and corset.

The limiting oxygen index (LOI) of the bare and silver nanowire decorated fabrics with a nanowire loading in the range of 0.05 mg/cm$^2$-50 mg/cm$^2$ prepared at a size of 5×15 cm$^2$ is measured using the standard method defined by ASTM D2863-08. As a result of this measurement, LOI of bare fabric is found as 18.5, while LOI of silver nanowire decorated fabrics with various nanowire densities are measured in between 18.6 and 29.

Metal nanowire decorated fabrics with high flame retardancy refer to a very wide area of use. They can particularly be used as protective fabrics. Some of them include car seat, pillow, seat, cushion, carpet, curtain, bedsheet, sweater, rug, anorak, shirt, trousers, shoes, boots, jacket, gloves, T-shirt, weal, scarf, blanket, portable heater, quilt, mattress, various undergarments, socks and corset.

Synthesis and purification routes of the silver nanowires used as a coating material for metal nanowire decorated heatable fabrics are described as follows.

Synthesis of Silver Nanowires

Silver nanowires are synthesized using the polyol method. In the polyol method, silver nitrate ($AgNO_3$ 99.5%) is used as the silver source, polyvinylpyrrolidone (PVP, MW=55,000) is used as the stabilizing polymer, and ethylene glycol (EG) is used as both the solvent and the reducing agent. In this method, a 10 ml EG solution is prepared by dissolving 500 mg PVP and 7 mg sodium chloride, and the solution is heated to 170° C. In the meantime a 5 ml EG solution is prepared with dissolving 100 mg silver nitrate and this solution is added dropwise into the first solution at 170° C.

Once the dropwise addition starts, silver nanoparticles nucleate and as the addition continues, nanoparticles unidirectionally grow (by means of PVP) and form silver nanowires. Silver nanoparticles that are not forming nanowires also grow and create undesired byproducts. Silver nanowire formation is realized as a result of the following reactions:

$$CH_2OH—CH_2OH \rightarrow CH_3CHO+H_2O$$

$$2AG^+ + 2CH_3CHO \rightarrow 2Ag^0 + CH_3COCOCH_3 + 2H^+$$

Nanoparticle and nanowire formation can be monitored through the change in the color of the synthesis solution. Necessary temperature for the synthesis was obtained by means of a silicon oil bath attached hot plate. As said, PVP dissolved ethylene glycol solution is increased to the desired temperature and silver nitrate in ethylene glycol solution is dropwise added into it. A syringe pump is used for precise control on dropwise addition. In a typical synthesis, feeding rate of silver nitrate in ethylene glycol solution is 5 ml/hour. Once the dropwise addition is completed, the solution is rested at the same temperature for 30 minutes and then cooled down to the room temperature.

Purification of Silver Nanowires

Purification is necessary following the synthesis of silver nanowires. The purpose of purification is to separate the ethylene glycol, stabilizing polymer and the particles described as by products, which are produced during synthesis. Purification is carried out by means of a centrifuge. First, the synthesis solution is diluted with acetone at a ratio of ¼, and is centrifuged at 7000 rpm for 20 minutes. This process is repeated twice. Then the obtained nanowires are diluted in ethanol again at a ratio of ¼ and centrifuged at 7000 rpm for 20 minutes. Finally, the obtained silver nanowires are dispersed in ethanol and then are used for coating and characterization.

What is claimed is:

1. A metal nanowire decorated heatable fabric, comprising a metal nanowire material with a density in the range of 0.05 mg/cm$^2$-50 mg/cm$^2$ per unit area, wherein the metal nanowire decorated heatable fabric is heated to a temperature range of 30° C.-150° C. when a voltage in the range of 0.5 V-15 V is applied, and consumes power in the range of 0.1-10 Watts under applied voltage of 0.5 V-15 V.

2. The metal nanowire decorated heatable fabric according to claim 1, wherein a power consumption under an applied bias of 1 V-7 V is 0.15 Watt-3.92 Watt.

3. The metal nanowire decorated heatable fabric according to claim 1, wherein the metal nanowire decorated heatable fabric is antibacterial.

4. The metal nanowire decorated heatable fabric according to claim 1, wherein, a limiting oxygen index of the metal nanowire decorated heatable fabric is in the range of 18.6 to 29.

5. The metal nanowire decorated heatable fabric according to claim 1, wherein, the metal nanowire material is selected from the group of silver, gold, platinum, copper, nickel and copper-nickel mixture.

6. The metal nanowire decorated heatable fabric according to claim 1, wherein the metal nanowire material is a three dimensional nanowire material coated with dip coating, spray coating, drop casting or spin coating.

7. The metal nanowire decorated heatable fabric according to claim 1, wherein the metal nanowire decorated heatable fabric is knitted or not knitted.

8. The metal nanowire decorated heatable fabric according to claim 1, wherein the metal nanowire decorated heatable fabric is cotton, silk, woolen, synthetic or a blend thereof.

9. The metal nanowire decorated heatable fabric according to claim 1, wherein the metal nanowire decorated heatable fabric is one selected from the group consisting of a pillow, seat, cushion, carpet, curtain, bedsheet, sweater, rug, anorak, shirt, trousers, shoes, boots, jacket, gloves, T-shirt, weal, scarf, steering wheel, blanket, quilt, mattress, undergarment, socks and corset.

10. A metal nanowire decorated heatable fabric, comprising a metal nanowire material with a density in the range of 0.05 $mg/cm^2$-50 $mg/cm^2$ per unit area, wherein the metal nanowire decorated heatable fabric is heated to a temperature range of 30° C.-150° C. when a voltage in the range of 0.5 V-15 V is applied, and consumes power in the range of 0.1-10 Watts under applied voltage of 0.5 V-15 V; and a limiting oxygen index of the metal nanowire decorated heatable fabric is in the range of 18.6 to 29.

* * * * *